US008684225B2

(12) United States Patent
Gelibert et al.

(10) Patent No.: US 8,684,225 B2
(45) Date of Patent: Apr. 1, 2014

(54) LOCKING CAP FOR A VESSEL HAVING A NECK

(75) Inventors: Stéphane Gelibert, Sassenage (FR); Guillaume Belle, Sassenage (FR)

(73) Assignee: A. Raymond et Cie, Grenoble (FR)

( * ) Notice: Subject to any disclaimer, the term of this patent is extended or adjusted under 35 U.S.C. 154(b) by 0 days.

(21) Appl. No.: 13/387,426

(22) PCT Filed: Aug. 17, 2010

(86) PCT No.: PCT/EP2010/061982
§ 371 (c)(1),
(2), (4) Date: Jan. 27, 2012

(87) PCT Pub. No.: WO2011/032798
PCT Pub. Date: Mar. 24, 2011

(65) Prior Publication Data

US 2012/0160850 A1 Jun. 28, 2012

(30) Foreign Application Priority Data

Sep. 15, 2009 (FR) ..... 09 56337

(51) Int. Cl.
*B65D 39/00* (2006.01)

(52) U.S. Cl.
USPC ..... 220/790; 220/320; 220/787; 215/277

(58) Field of Classification Search
USPC ..... 220/315, 320, 784, 786, 787, 790; 215/249, 277
See application file for complete search history.

(56) References Cited

U.S. PATENT DOCUMENTS 2,162,752 A 6/1939 Schauer
2,162,754 A 6/1939 Schauer (Continued)

FOREIGN PATENT DOCUMENTS

DE 9306796 7/1993
DE 19708909 9/1998

(Continued)

OTHER PUBLICATIONS

Office Action from Canadian I.P. Office for Application No. 2,771,368 dated Apr. 8, 2013.

*Primary Examiner* — Anthony Stashick
*Assistant Examiner* — Christopher McKinley
(74) *Attorney, Agent, or Firm* — Harness, Dickey & Pierce, P.L.C.

(57) ABSTRACT

The invention relates to a locking cap (1) made of a molded plastic material for a vessel (2) having a neck, intended for blocking a stopper (4) in said neck (3), including a wire-cap (6) adapted for surrounding the stopper (4) and the neck in the mounted configuration of the cap (1). The wire-cap includes first and second flexible tabs capable of being respectively blocked on the neck and on the stopper (4), said first tabs (8) being offset relative to said second tabs (9) in an axial direction relative to said neck (3). The cap (1) also includes a ring (7) surrounding the wire-cap (6) for preventing access to said tabs from outside the ring (7). The ring (7) and the wire-cap (6) are designed so as to be fitted and locked together. The tabs (8, 9) of the wire-cap are respectively arranged at an angle in first and second openings (13, 14) which are formed by the mesh of the wire-cap (6), and in which the tabs (8, 9) can disappear when mounting the cap (1) on the neck (3).

25 Claims, 2 Drawing Sheets

(56) References Cited

U.S. PATENT DOCUMENTS

| | | | |
|---|---|---|---|
| 2,961,119 | A | 11/1960 | Leach |
| 3,117,701 | A | 1/1964 | Stull |
| 3,193,218 | A | 7/1965 | Ravn |
| 3,603,471 | A | 9/1971 | Harris, Sr. et al. |
| 3,823,841 | A | 7/1974 | Lovejoy |
| 3,920,141 | A | 11/1975 | Bojardi |
| 4,211,333 | A | 7/1980 | Villarejos |
| 4,251,003 | A | 2/1981 | Bodenmann |
| 4,456,138 | A | 6/1984 | Bereziat |
| 5,125,921 | A | 6/1992 | Duschek |
| 5,303,835 | A | 4/1994 | Haber et al. |
| 5,305,835 | A | 4/1994 | Campbell et al. |
| 5,314,084 | A | 5/1994 | Folta et al. |
| 5,467,878 | A | 11/1995 | Derksen |
| 5,555,988 | A | 9/1996 | Koch et al. |
| 5,562,219 | A | 10/1996 | de Pous et al. |
| 5,738,233 | A | 4/1998 | Burns |
| 5,799,810 | A | 9/1998 | de Pous et al. |
| 5,817,082 | A | 10/1998 | Niedospial, Jr. et al. |
| 5,819,964 | A | 10/1998 | Grimard |
| 5,823,373 | A | 10/1998 | Sudo et al. |
| 5,957,314 | A | 9/1999 | Nishida et al. |
| 5,972,297 | A | 10/1999 | Niermann et al. |
| 5,992,660 | A | 11/1999 | Miura et al. |
| 6,042,770 | A | 3/2000 | Sudo et al. |
| 6,095,355 | A | 8/2000 | Jessen et al. |
| 6,186,359 | B1 | 2/2001 | de Pous et al. |
| 6,341,706 | B1 | 1/2002 | Neuner |
| 6,378,714 | B1 | 4/2002 | Jansen et al. |
| 6,409,049 | B1 | 6/2002 | de Pous et al. |
| 6,543,648 | B2 | 4/2003 | de Pous et al. |
| 6,568,439 | B1 | 5/2003 | Se et al. |
| 6,588,614 | B2 | 7/2003 | Neuner |
| 6,591,998 | B2 | 7/2003 | Haynes et al. |
| 6,601,721 | B2 | 8/2003 | Jansen et al. |
| 6,604,561 | B2 | 8/2003 | Py |
| 6,681,475 | B2 | 1/2004 | Thibault et al. |
| 6,739,781 | B2 | 5/2004 | Maloney et al. |
| 6,868,978 | B2 | 3/2005 | Amschlinger et al. |
| 6,904,662 | B2 | 6/2005 | Thibault et al. |
| 7,100,646 | B2 | 9/2006 | Py et al. |
| 7,198,757 | B2 | 4/2007 | Chiarin |
| 7,243,689 | B2 | 7/2007 | Py |
| 7,309,469 | B2 | 12/2007 | Anderson et al. |
| 7,488,307 | B2 | 2/2009 | Rimlinger et al. |
| 7,490,639 | B2 | 2/2009 | Py |
| 7,562,783 | B2 | 7/2009 | Bourreau et al. |
| 7,611,025 | B2 | 11/2009 | Nusbaum et al. |
| 7,611,026 | B1 | 11/2009 | Bloom et al. |
| 7,712,618 | B2 | 5/2010 | Barre et al. |
| 7,726,357 | B2 | 6/2010 | Py et al. |
| 7,810,529 | B2 | 10/2010 | Py |
| 7,841,484 | B2 | 11/2010 | Kaneko et al. |
| 7,845,505 | B2 * | 12/2010 | Hamamoto et al. ..... 215/277 |
| 7,850,028 | B2 | 12/2010 | Morini |
| 7,922,019 | B2 | 4/2011 | Granger |
| 7,967,034 | B2 | 6/2011 | Py |
| RE42,553 | E | 7/2011 | de Pous et al. |
| 7,980,276 | B2 | 7/2011 | Py |
| 8,056,756 | B2 | 11/2011 | Okiyama |
| 8,225,949 | B2 | 7/2012 | Aneas |
| 8,303,914 | B2 | 11/2012 | Zurcher |
| 2003/0098286 | A1 | 5/2003 | Bloom et al. |
| 2003/0108455 | A1 | 6/2003 | Brockwell |
| 2004/0217081 | A1 | 11/2004 | Konrad |
| 2007/0102393 | A1 | 5/2007 | Colin et al. |
| 2007/0131641 | A1 | 6/2007 | Higgins |
| 2008/0105640 | A1 | 5/2008 | Ott |
| 2008/0237178 | A1 | 10/2008 | Ochoa Laburu |
| 2010/0050575 | A1 | 3/2010 | Aneas |
| 2010/0089862 | A1 * | 4/2010 | Schmitt ..... 215/249 |
| 2010/0243599 | A1 | 9/2010 | Chae |

FOREIGN PATENT DOCUMENTS

| | | | |
|---|---|---|---|
| FR | 2036746 | | 12/1970 |
| FR | 2908396 | | 5/2008 |
| FR | 2912384 | A1 | 8/2008 |
| JP | 378947 | | 1/1960 |
| JP | 7165252 | | 6/1995 |
| JP | 2007-137482 | A | 6/2007 |
| WO | 94/04424 | | 3/1994 |
| WO | WO-9953886 | A1 | 10/1999 |
| WO | 01/60699 | | 3/2001 |
| WO | WO2006/120539 | A2 | 11/2006 |

* cited by examiner

LOCKING CAP FOR A VESSEL HAVING A NECK

CROSS-REFERENCE TO RELATED APPLICATION

This application is a U.S. National Phase Patent Application based on International Application Serial No. PCT/EP2010/061982 filed Aug. 17, 2010, the disclosure of which is hereby explicitly incorporated by reference herein.

BACKGROUND OF THE INVENTION

1. Field of the Invention

The present invention concerns a locking cover made of a molded plastic material for a vessel having a neck.

2. Description of the Related Art

Patent document FR-2893922 discloses a locking cover as described above, in which the cage has a peripheral ring (503A) connected by its bottom edge alternatively to locking tongues of the neck (503G) and to arms (503D) provided with locking tongues for locking onto the stopper. Between the ring and the locking tongues there is a peripheral seat in which is inserted a locking element that pushes the tongues back onto the neck and thus fastens the cover on the neck. This, therefore, constitutes a two-stage locking process for locking the cover on the vessel. A disadvantage of this locking cover is that its production by molding entails a large amount of material and a complex mold.

SUMMARY OF THE INVENTION

The present invention concerns a locking cover made of a molded plastic material for a vessel having a neck, intended to fix a stopper in the neck of the vessel, comprising a cage adapted to surround the stopper and the neck in the mounted configuration of the cover, said cage having first flexible tongues adapted to fix themselves to the neck of the vessel and second flexible tongues adapted to fix themselves to the stopper, said first tongues being offset from said second tongues in a given axial direction relative to the neck of the vessel, said cover further comprising a ring that surrounds the cage in such a way as to prevent access to said first and second tongues from outside the ring.

The invention applies more particularly to a locking cover for a necked vessel used particularly in the medical field, in which an elastomeric or rubber stopper is inserted in the neck of the vessel to close the latter in a leaktight manner and, if need be, to keep its contents sterile. Access to the contents of the vessel is obtained by inserting a needle in the stopper through the center of the cover without removing the stopper, thus eliminating any risk of contamination of the contents. The cover thus serves as a safety link between the stopper and the neck of the vessel.

The object of the invention is to offer another locking cover for a vessel having a neck, which can be mounted on the neck quickly and easily, while at the same time being simple and inexpensive to produce.

To this end, the invention is directed to a locking cover made of a molded plastic material for a vessel having a neck, intended to fix a stopper in the neck of the vessel, comprising a cage adapted to surround the stopper and the neck in the mounted configuration of the cover, said cage having first flexible tongues adapted to fix themselves to the neck of the vessel and second flexible tongues adapted to fix themselves to the stopper, said first tongues being offset from said second tongues in a given axial direction of the cover, said cover further comprising a ring that surrounds the cage in such a way as to prevent access to said first and second tongues from outside the ring, characterized in that the ring and the cage are designed to nest one inside the other and to interlock, the ring coming to surround the cage, and in that said first and second tongues of the cage are disposed slantingly respectively in the first and the second openings which are formed by the mesh openings of the cage and into which said tongues can deflect as the cover is being mounted on the neck of the vessel.

With an arrangement of this kind, the locking cover is easy to mount on the neck of the vessel: once the cage has been introduced into and locked inside the ring and the stopper has then been inserted in the cage and locked in place by means of the second tongues, the cover, with the stopper, is then simply inserted onto the neck by the application of axial pressure until the first tongues lock onto the neck. The result, therefore, is a locking cover that is easy to mount on the neck of the vessel and permits quick, easy access to the contents of the vessel by way of the stopper.

In addition, the locking cover can be produced very easily and economically by molding the cage and the ring in respective double-cavity, single-core molds.

A locking cover according to the invention can advantageously have the following particularities:

- it is provided with breakaway regions for breaking away the cage, disposed on one and the other side of each first tongue;
- the ring has a continuous cylindrical surface with internal guide bosses disposed to insert in the openings of the cage;
- the interlock device of the cage and the ring is a catch and notch arrangement;
- the ring has a central aperture intended to be closed by a removable cap adapted to snap onto the ring.

In one form thereof, the present invention provides a locking cover made of a molded plastic material for a vessel having a neck, intended to fix a stopper in the neck of the vessel, including a cage adapted to surround the stopper and the neck in the mounted configuration of the cover, the cage having first flexible tongues adapted to fix themselves to the neck of the vessel and second flexible tongues adapted to fix themselves to the stopper, the first tongues being offset from the second tongues in a given axial direction of the cover, the cover further including a ring that surrounds the cage in such a way as to prevent access to the first and second tongues from outside the ring, characterized in that the ring and the cage are designed to nest one inside the other and to interlock, the ring coming to surround the cage, and in that the first and second tongues of the cage are disposed slantingly respectively in the first and the second openings which are formed by the mesh openings of the cage and into which the tongues can deflect as the cover is being mounted on the neck of the vessel.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
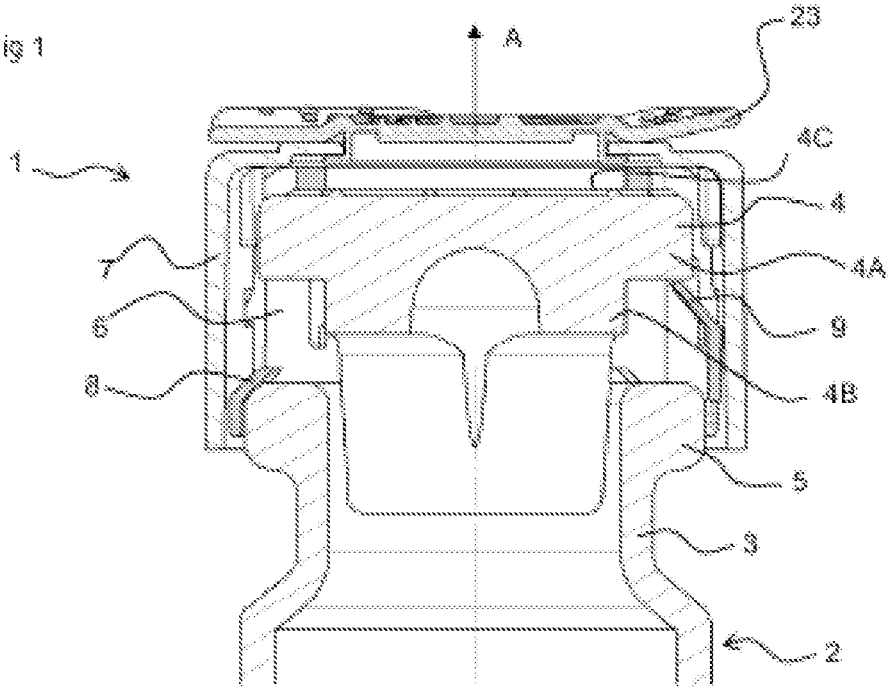
FIG. 1 is a schematic representation in axial section of a locking cover according to the invention, mounted on a stopper inserted in a necked vessel.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION

Represented in FIG. 1 is a locking cover 1 for a vessel 2 having a neck 3 according to the invention, intended to fix a stopper 4 in the neck 3 of the vessel 2, said cover 1 being shown here in a mounted position in which it is merely placed on the neck 3 without being locked.

The neck 3, which here has a circular opening, has at its end a peripheral outer lip 5 to which the locking cover 1 fixes itself when the cover 1 is locked on the neck 3 of the vessel 2. The stopper 4 here has a conventional, generally cylindrical, "T" shape, with a head 4A and a foot 4B, the head being slightly larger in diameter than the foot 4B, such that when the foot 4B of the stopper 4 is inserted in the neck 3, the head 4A abuts against the lip 5 of the neck 3.

As can be seen in FIG. 1, the locking cover 1 comprises a cage 6 adapted to surround the stopper 4 and the neck 3, in the locked configuration of the cover 1 on the vessel 2, and a ring 7 adapted to nest over the cage 6, surrounding it. The cage 6 serves to fix the stopper 4 in the neck 3 by means of flexible tongues 8, 9 disposed on the periphery of the cage 6. In the mounted configuration of the cover 1, the ring 7 laterally overlaps the cage 6 completely, thereby preventing any access to the cage 6 and the tongues 8, 9 from outside the ring 7. In addition, the cover 1 is provided with a removable safety cap 23 adapted to snap onto the ring 7 to prevent access to the stopper 4.

Figure 2:
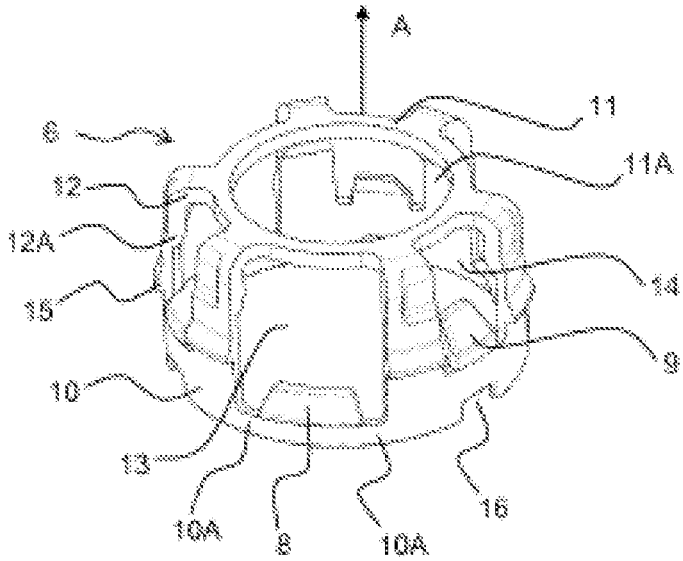
FIG. 2 is a schematic perspective view of the cage of the locking cover according to the invention.

As can be seen in FIG. 2, the cage 6 comprises two circlets 10, 11 connected to each other by a plurality of substantially identical arms 12 extending in an axial direction A and forming between them first and second openings 13, 14 corresponding to the mesh openings of the cage 6.

Depicted here are a first, lower circlet 10 that is to be inserted first into the neck 3 of the vessel 2, and a second, upper circlet 11, which is preferably smaller in diameter than the first circlet 10 and is intended to rest on an upper portion 4C of the head 4A of the stopper 4 when the cover 1 is mounted on the stopper 4. Circlet 11 defines, at the center of the cage 6, an aperture 11A—here circular—that is coaxial with the neck 3 of the vessel 2 when the cover 1 is placed on the neck 3, to permit access to the stopper 4 and the vessel 2.

It will be understood that circlet 11 and the arms 12 are sufficiently rigid so that they do not collapse as the cage 6 is inserted in the ring 7.

Shown here are six arms 12 evenly distributed over the periphery of the circlets 10, 11, but their number can vary without departing from the framework of the invention.

As visible in FIG. 2, first flexible tongues 8 adapted to fix themselves to the neck 3 of the vessel 2 and second flexible tongues 9 adapted to fix themselves to the stopper 4—here, three of each—are disposed, preferably in alternation, on the periphery of circlet 10 between two consecutive arms 12.

The first and second tongues 8, 9 are disposed slantingly in, respectively, the first and the second openings 13, 14 formed by the mesh openings of the cage 6, and are supported by circlet 10 and extend toward the inside of the cage 6 and in the direction of second circlet 11. In this way, when the cage 6 is inserted onto the neck 3 or the stopper 4, the first and second tongues 8, 9 can, in a first stage, deflect elastically into the first and the second openings 13, 14, respectively, assuming a position substantially parallel to the arms 12, and then, in a second stage, resume their slanted position to lock the cage 6 respectively on the neck 3 or on the stopper 4.

As visible in FIG. 2, the first tongues 8 are offset in axial direction A with respect to the second tongues 9. More precisely, the second tongues 9 are raised in the direction of the second circlet 11, such that the distance between the end of a second tongue 9 and circlet 11 substantially corresponds to the height of the head 4A of the stopper 4, so as to lock the head 4A of the stopper 4 between second tongues 9 and circlet 11. Likewise, the distance between the end of a first tongue 8 and circlet 11 is adapted to lock the first tongues 8 against the lip 5 of the neck 3 of the vessel 2 when the cover 1 is locked on the neck 3.

As represented in FIG. 2, disposed on one and the other side of each first tongue 8 are regions 10A of first circlet 10 that are relatively thin compared to the thickness of the mesh openings, thus forming cut-downs on each side of the tongue 8 and making these regions into breakaway regions that yield if an attempt is made to remove the cage 6 from the vessel 2. It will be understood that regions 10A represent the smallest wall section of the cage 6. Thus, as the cover 1 is locked onto the neck 3 by the application of an axial or other force to the cage 6, the first tongues 8 are retained by the lip 5, thereby producing a torsion torque in regions 10A. One or more of these regions 10A can then break under the effect of the torsion and indicate that the vessel 2 has been opened. It will be noted that tongues 8 here are shaped in such a way that their height allows them to pass under the lip 5 of the neck 3 of the vessel 2, and a pull exerted on the cage 6 causes them to rotate under the lip 5, thus further increasing the torsion effect in regions 10A.

It will be noted that first tongues 8 and the corresponding openings 13 here are wider than second tongues 9 and the corresponding openings 14, thus making it possible for the cage 6 to be fixed more firmly to the neck 3 than to the stopper 4.

As can be seen in FIG. 2, each arm 12 of the cage 6 is further provided with an outer positive catch 15 that extends outward toward the first circlet 10 and is intended to fasten the ring 7 on the cage 6, the inclination of the catches 15 serving to facilitate the insertion of the cage 6 in the ring 7.

It can also be seen in FIG. 2 that each arm 12 of the cage 6 is reinforced, at the level of its upper portion adjoining second circlet 11, by an inner bulge 12A intended to wedge the stopper 4 in place in the mounted position of the cover 1.

In addition, formed on circlet 10 of the cage 6, opposite every second tongue 9, are respective notches 16 (here, three in number) intended to assist in orienting the cage 6 with respect to an automatic assembly machine during the assembly of the cage 6 and the ring 7 to form the cover 1.

Figure 3:
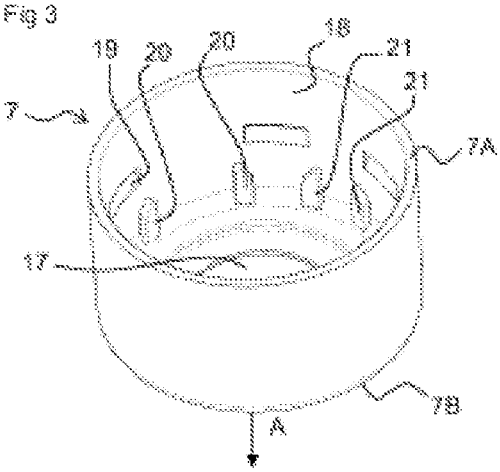
FIG. 3 is a schematic perspective view of the ring of the locking cover according to the invention.

FIG. 3 represents the ring 7 in the form of a sleeve having a continuous, substantially cylindrical surface, which in the mounted configuration of the cover 1 surrounds the cage 6 to prevent access to the tongues 8, 9. The ring 7 has an open bottom end 7A that is to be inserted first onto the cage 6 and a top end 7B that is partially closed, with the result that when the ring 7 is nested on the cage 6, the top end 7B of the ring 7 overlaps the cage 6 while at the same time leaving at the center of the ring 7 an aperture 17, circular in this case, that is coaxial with the aperture 11A of the cage 6, and, when the cover is mounted on the neck 3, coaxial with the neck 3, to permit access to the stopper 4 and the vessel 2.

Ring 7 is provided on an inner wall 18 with notches 19 designed to cooperate with the catches 15 of the cage 6 to form an interlock device that locks the ring 7 on the cage 6. The notches 19 are preferably blind, that is, they do not pass all the way through the wall 18 of the ring 7, to make for a compact cover 1 and to keep impurities from getting inside the cover 1.

The ring 7 is further provided on its inner wall 18 with internal guides 20, 21 intended to interpose themselves between the arms 12 of the cage 6 to guide the positioning of the cage 6 relative to the ring 7 as the cage 6 is inserted in the ring 7. It will be understood that the guides 20, 21 preferably have dimensions respectively adapted to openings 13, 14, with a height in the axial direction A that is less than the height of openings 13, 14, to enable the tongues 8, 9 to deflect into the openings 13, 14 when the cover 1 is inserted on the neck 3. Represented here for each guide 20, 21 is a pair of respective bosses that position themselves laterally in a mesh opening of the cage 6 respectively against adjacent arms 12 of the cage 6 when the ring 7 and the cage 6 are nested one inside the other. These bosses here have a beveled shape on the side abutting an arm 12, to further facilitate the guiding of the cage 6 into the ring 7.

Figure 4:
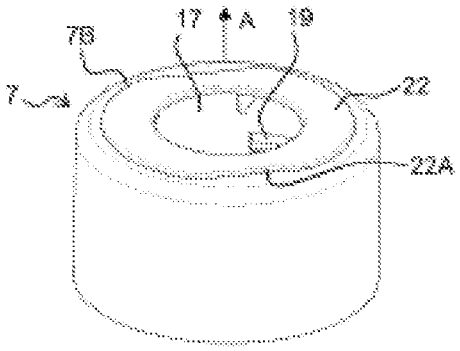
FIG. 4 is another schematic perspective view of the ring from FIG. 3.

As represented in FIG. 4, the top end 7B of the ring 7 is provided with a shoulder 22, circular in this case, which borders aperture 17 and is truncated to form two substantially parallel sides 22A, thus providing a means of orienting the ring 7 relative to the automatic assembly machine.

Figure 5:
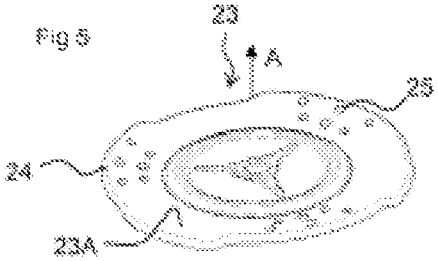
FIG. 5 is a schematic perspective view of the cap of the locking cover according to the invention.

FIG. 5 shows the cap 23 seen from its external side 23A (that is, the external side of cap 23 when it is snapped onto cover 1). Cap 23 here has the shape of a disk with raised wings 24 (three wings in this case), equipped on external side 23A with gripping elements 25, here in the form of reinforcing studs, to make the cap 23 easier to take hold of when it is to removed from the cover 1. The gripping elements could also be in the form of circular-arc-shaped beads or any element in relief facilitating the grasping of the cap 23.

Figure 6:
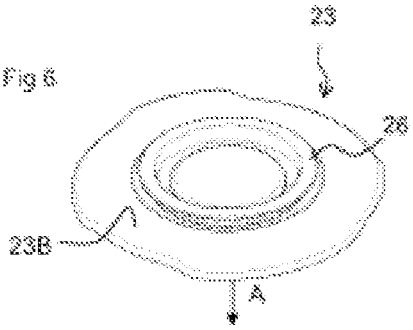
FIG. 6 is another schematic perspective view of the cap from FIG. 5.

FIG. 6 shows the cap 23 from the internal side 23A (that is, the side of the cap 23 that is in contact with the cover 1 when snapped onto the cover 1). An annular bead 26 is formed here at the center of the internal side 23A of the cap 23 and is intended to be inserted in the aperture 17 of the ring 7. When the cap 23 is snapped onto the cover 1, the bead 26 is preferably bent back toward the outside, assuming an L-shaped profile, to hold the cap 23 on the cover 1 as described below.

The cap 23 can be mounted initially on the ring 7 by snap fastening or welding, or by any other irreversible method of attachment known to those skilled in the art. For example, to mount the cap by snap fastening, the cap 23 is first inserted on the ring 7 by inserting the bead 26 into the aperture 17 of the ring 7, and the assembly is then heated to deform the bead 26 in order to bend it around the upper portion 7B of the ring 7 and give it its L-shaped profile, thus making it possible to jam the cap 23 onto the ring 7, as is visible in FIG. 1.

It will be understood that the overall cylindrical shape of the cage 6 and the ring 7 makes it possible for the cover 1 to adapt to all types of vessels 2 having a lipped circular neck 3, and does not require orienting either the cover 1 or the stopper 4 on the neck 3.

The cage 6, the ring 7 and the cap 23 of the cover 1 are preferably made by molding a plastic material, adapted to withstand a lyophilization process if need be. In particular, the plastic material of the cage 6 is hard, so that the torsion described earlier above causes the breakaway regions 10A to break rather than just elastically deform.

The respective shapes of the cage 6, the ring 7 and the cap 23 are relatively simple, thus permitting the use of double-cavity molds with a single core and axial stripping, and, consequently, easy and inexpensive production. In addition, the simplified shapes of these elements advantageously make it possible to reduce the amount of material necessary for the production of the cover 1.

Figure 7:
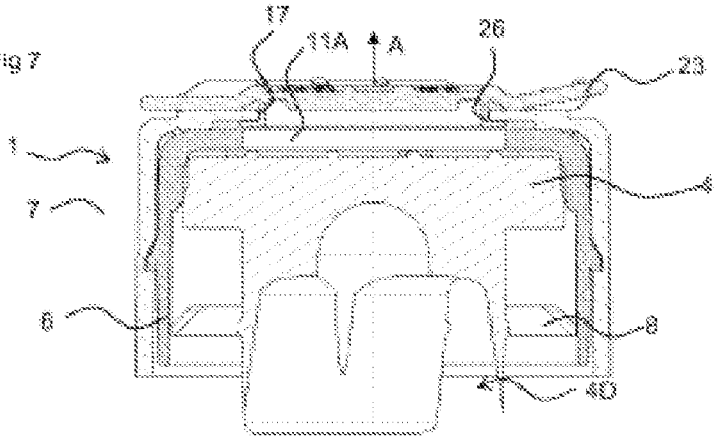
FIG. 7 is a schematic representation in axial section of the locking cover according to the invention, closed by a cap and mounted on a stopper.

The assembly of the cover 1 and the stopper 4 will now be described with reference to FIG. 7. The first step is to insert the cap 23 onto the ring 7 and to secure it as described above, such that the cap 23 closes the aperture 17 of the ring 7. The cage 6 is then inserted in direction A into the ring 7 provided with the cap 23, the openings 13, 14 of the cage 6 being lined up with the respective guides 20, 21 of the ring 7, until the catches 15 of the cage 6 seat in the notches 19 of the ring 7. The aperture 11A of the cage 6 is then closed by means of the cap 23.

The stopper 4 is then placed in the cover 1 easily and without effort, merely by applying axial pressure in direction A. The head 4A of the stopper 4 is inserted in the cage 6 until the upper portion 4C of the stopper 4 comes into contact with the upper circlet 11 of the cage 6. As the stopper 4 is inserted, the second tongues 9 deform elastically to let the stopper past and then go back to their initial shape once the stopper 4 is in place, positively engaging behind the head 4A of the stopper 4, so as to lock the stopper 4 in the position indicated in FIG. 4. The stopper 4 is then fixed over its periphery in the cage 6 by the bulges 12A, in the position indicated in FIG. 7.

The assembly formed by the locking cover 1 and the stopper 4 can then be mounted on a vessel 2 by inserting the foot 4B of the stopper 4 into the neck 3 of the vessel 2 simply by applying axial pressure to the cover 23 in direction A, thereby forcing the first tongues 8 to deform elastically in order to get past the lip 5 of the neck 3, and then to resume their initial shape and thus positively engage behind the neck 3 and lock the cover 1 on the neck 3. At the same time, the second tongues 9 partially deflect against the neck 3 of the vessel 2.

The result is a closure for the vessel 2 that is leaktight due to the stopper 4 and tamper-proof by virtue of the locking cover 1, since the cage 6 serves to lock the stopper 4 in the neck 3 and the ring 7 prevents any access to the cage 6, and in particular to the tongues 8, 9. It will be appreciated that the cage 6 therefore serves as a link that fastens together the vessel 2, the stopper 4 and the second ring 7 provided with the cap 23, and that the second ring 7 serves as a safeguard.

For some medical applications, it may be necessary to lyophilize the contents of the vessel 2. In that case, after contents for lyophilization have been introduced into the sterile vessel 2, the foot 4B of the stopper 4 locked in the cover 1 is placed in the neck 3 without pushing it all the way in and without engaging the first tongues 8 on the neck 3, in the position shown in FIG. 1. An opening 4D in the foot 4B of the stopper 4 (more visible in FIG. 7) then makes it possible to proceed with the desired lyophilization. Once the lyophilization has been performed, the stopper 4 with the cover 1 can be pushed the rest of the way into the neck 3, as indicated above, to hermetically seal the vessel 2.

When it is desired to access the contents of the vessel 2, the cap 23 need only be removed to expose the respective apertures 11A, 17 of the cage 6 and of the ring 7, and thus the upper portion 4C of the stopper 4, into which a needle can be inserted to penetrate into the vessel 2. The contents of the vessel 2 can then be used and, if need be, rehydrated.

It will be understood that once the cap 23 has been removed it cannot be reattached to the locking cover 1, so single use of the vessel 2 is assured. Furthermore, the locking cover 1 cannot be removed from the vessel 2 without damaging the breakaway regions 10A of the cage 6, which is readily visible and eliminates any risk of reuse of the vessel 2.

It will also be noted that since the stopper 4 is inserted in the cover 1 after the assembly of the cage 6, the ring 7 and the cap 23 to form the cover 1, the cover 1 and the stopper 4 can advantageously be stored separately before use.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A locking cover for use in fixing a stopper in a neck of a vessel, the locking cover comprising:

a cage structured to surround the stopper and the neck in a mounted configuration of the cover, the cage including first flexible tongues engagable with the neck of the vessel and second flexible tongues engagable with the stopper, the first tongues being offset from the second tongues in an axial direction of the cover; and a ring surrounding the cage to obstruct access to disengage the first and second tongues from the neck and the stopper, respectively, the ring and the cage dimensioned to nest one inside the other and to interlock with one another, the first and second tongues of the cage obliquely angled with respect to the axial direction and deflectable within respective first and second openings of the cage in the mounted configuration of the cover to the neck of the vessel.

2. The cover of claim 1, wherein the cage includes breakaway regions disposed on each side of each of the first tongues and configured to break before the first tongues disengage from the neck of the vessel when a removal force is applied to the cover.

3. The cover of claim 1, wherein the ring includes a continuous cylindrical surface with internal guide bosses insertable in the openings of the cage.

4. The cover of claim 1, wherein an interlock device of the cage and the ring has a catch and notch arrangement.

5. The cover of claim 1, wherein the ring includes a central aperture closable by a removable cap engagable with the ring.

6. The cover of claim 1, wherein the ring radially overlaps the cage.

7. The cover of claim 1, wherein the cage and the ring of the locking cover are a molded plastic material, the vessel contains sterile medical contents, and the stopper allows needle insertion therethrough without removal of the cage, ring or stopper.

8. A locking cover for fixing a stopper in a neck of a vessel, the locking cover comprising:

a cage including a hollow and substantially cylindrical body receiving the stopper, first tongues extending inwardly from the body, and second tongues extending inwardly from the body, the first tongues engaging the neck of the vessel to axially position the cage relative to the neck, the second tongues engaging the stopper to axially position the stopper relative to the cage; and a hollow and substantially cylindrical ring surrounding the cage and having an open bottom and a partially closed top, the partially closed top extending radially inwardly over the cage, the cage and ring acting as a tamper-proof closure.

9. The locking cover of claim 8, wherein the first tongues are configured to engage an upper surface of a lip of the neck to position the locking cover in a first axial position relative to the neck.

10. The locking cover of claim 9, wherein the second tongues are configured to axially position the stopper to provide an axial gap between an underside surface of the stopper and the upper surface of the lip when the locking cover is in the first axial position.

11. The locking cover of claim 10, wherein the first tongues are configured to engage an underside surface of the lip of the neck to position the locking cover in a second axial position relative to the neck.

12. The locking cover of claim 11, wherein the underside surface of the stopper engages the upper surface of the lip to seal the vessel when the locking cover is in the second axial position.

13. The locking cover of claim 12, wherein the first tongues flex radially outward to allow the locking cover to be moved from the first axial position to the second axial position.

14. The locking cover of claim 8, wherein the second tongues flex radially outward to allow the stopper to be inserted into the cage when the ring surrounds the cage.

15. The locking cover of claim 8, wherein the ring defines a plurality of notches and the cage includes a plurality of catches configured to engage the plurality of notches to axially position the ring relative to the cage.

16. The locking cover of claim 8, wherein the first tongues have a first width and the second tongues have a second width that is less than the first width.

17. The cover of claim 8, wherein the cage and the ring of the locking cover are a molded plastic material, the vessel contains sterile medical contents, and the stopper allows needle insertion therethrough without removal of the cage, ring or stopper.

18. A locking cover for fixing a stopper in a neck of a vessel, the locking cover comprising:

an inner member including an inner surface configured to receive the stopper, the inner member including a first inwardly projecting surface configured to engage the neck of the vessel to fix the inner member relative to the neck, the inner member including a second surface configured to engage the stopper to fix the stopper within the inner member, the inner member including a breakaway region configured to break before the first surface disengages from the neck when a removal force is applied to the locking cover; and an outer member substantially surrounding the inner member to deter tampering therewith.

19. The locking cover of claim 18, wherein the breakaway region has a first cross sectional area that is less than a second cross sectional area of a remainder of the inner member.

20. The locking cover of claim 18, wherein the inner member defines an opening extending radially therethrough, and the breakaway region is disposed between the opening and an end surface of the inner member.

21. The locking cover of claim 20, wherein the opening includes a plurality of openings and the breakaway region has a first thickness that is less than a second thickness of the inner member between the plurality of openings.

22. The cover of claim 18, wherein the inner member and the outer member of the locking cover are a molded plastic material, the vessel contains sterile medical contents, and the stopper allows needle insertion therethrough without removal of the inner member, outer member or stopper.

23. A locking cover for fixing a stopper in a neck of a vessel, the locking cover comprising:

a cage including a hollow and substantially cylindrical body configured to receive the stopper, a first plurality of tongues extending radially inward from the body, a second plurality of tongues axially offset from the first plurality of tongues and extending radially inward from the body, and a plurality of catches extending radially outward from the body, the second plurality of tongues being configured to engage the stopper to axially position the stopper relative to the cage when the stopper is inserted into the cage, the body including a breakaway region configured to break when a removal force is applied to the locking cover; and a hollow and substantially cylindrical ring configured to surround the cage and having an open bottom and a partially closed top extending radially inwardly over the cage, the ring defining a plurality of notches configured to receive the plurality of catches on the cage to axially position the cage relative to the ring.

24. The locking cover of claim 23, wherein the ring has a reduced thickness section.

25. The locking cover of claim 24, wherein the reduced thickness section of the ring is located at the plurality of notches.

* * * * *